US008485830B1

(12) United States Patent
Tsai

(10) Patent No.: US 8,485,830 B1
(45) Date of Patent: Jul. 16, 2013

(54) SOCKET HAVING SYMMETRICALLY ARRANGED FIRST AND SECOND CASINGS WITH INTERLOCKING ARRANGEMENTS TO DEFINE A LED SEAT

(75) Inventor: Chang Fu Tsai, Taichung (TW)

(73) Assignee: Tung Ling Wang, Taichung (TW)

( * ) Notice: Subject to any disclaimer, the term of this patent is extended or adjusted under 35 U.S.C. 154(b) by 3 days.

(21) Appl. No.: 13/423,882

(22) Filed: Mar. 19, 2012

(30) Foreign Application Priority Data

Jan. 17, 2012 (TW) ..... 101201018 A

(51) Int. Cl.
*H01R 12/00* (2006.01)

(52) U.S. Cl.
USPC ..... 439/56

(58) Field of Classification Search
USPC ..... 439/56, 353, 611, 419; 362/640, 362/647, 649
See application file for complete search history.

(56) References Cited

U.S. PATENT DOCUMENTS

| | | | | |
|---|---|---|---|---|
| 4,210,380 | A * | 7/1980 | Brzostek | 439/456 |
| 6,200,003 | B1 * | 3/2001 | Tseng | 362/249.06 |
| 7,001,222 | B2 * | 2/2006 | Mazzullo et al. | 439/695 |
| 7,322,828 | B1 * | 1/2008 | Chiang | 439/56 |
| 7,717,608 | B2 * | 5/2010 | Liao | 362/640 |
| 2002/0009932 | A1 * | 1/2002 | Inaba et al. | 439/701 |
| 2006/0148300 | A1 * | 7/2006 | Huang et al. | 439/353 |

* cited by examiner

*Primary Examiner* — Chandrika Prasad
(74) *Attorney, Agent, or Firm* — Muncy, Geissler, Olds & Lowe, PLLC

(57) ABSTRACT

An socket for light string is provided to include a pair of symmetrically arranged first and second casings mated together. Each of the first and second casings is featured with a side opening, and a first and second end channels, interlocking arrangements provided at internal wall thereof so as to securely interlock the first and second casings to configure the socket with a LED seat formed by the openings to host an LED, and passages for securely receiving conductive wires configured by the first and second channels. A partition is provided under the LED seat so as to insulatively isolated the conductive wires. Inner surfaces of the channels are provided with teeth to firmly hold the conductive wires. The socket is preferable for the use of configuring a light string.

9 Claims, 7 Drawing Sheets

SOCKET HAVING SYMMETRICALLY ARRANGED FIRST AND SECOND CASINGS WITH INTERLOCKING ARRANGEMENTS TO DEFINE A LED SEAT

BACKGROUND OF THE INVENTION

1. Field of the Invention

The present invention relates to a socket, and more particularly to a bulb socket which is featured to be readily manufactured by means of automatic production line. The socket is configured by a pair of substantially symmetrical halves in which an light emitting diode (LED) and a pair of conductive wires can be readily positioned therebetween so as to provide a reliable and cost-effective configuration readily for mass production.

2. Description of Prior Art

The conventional light string, such as the light strings generally used in Christmas and New Year season, which is mostly assembled manually. Among one of the light strings, it is generally configured with five essential components, i.e. light bulb, bulb holder, socket, contacts and conductive wires. The contacts are stamped and bent to attach to the conductive wires, and then the sub-assembly of the contact-conductive wires are assembled to the socket. Then the light bulb along with its bulb holder is assembled to the socket so as to complete the assembly of a conventional light string.

There is another conventional light string, and which is configured with a light bulb with two conductive legs, solder, glue, a pair of conductive wires and a heat shrink tube. Firstly, the insulative layer of the conductive wires are removed so as to expose a section of copper. Then those two conductive legs are soldered to the copper respectively and enveloped with a layer of glue around a solder joint formed thereof so as to provide a reliable interconnection. Finally, the heat shrink tube is enveloped onto the solder joint and then heat is applied to make the seal between the conductive legs and the conductive wires. However, this conventional light string is still reliable on manual assembling.

Since manual assembling is time consuming, and human mistakes are frequently happened during assembling and causing high yield of defective light string. In addition, the work stations for manual assembling is comparably redundant and complicated which all attribute to high material cost and increase burden of assembling. This makes the assembling and management complicated.

SUMMARY OF THE INVENTION

It is therefore an object of the present invention to provide an improved socket configured with a pair of sysmetrical and interengageable casings, namely first and second casings. Since those two interengageable casings can be readily assembled together to configure the bulb, there is no orientation, gender in a way such that the manufacturing process can be readily performed by means of automation with auto feeder. As such, there is no need of manual labor so as to reduce human errors, and keep the quality high and defective rate low.

It is still an object of the present invention to provide an improved socket in which each of the symmetric casing is provided with an LED seat with an insulative partition arranged thereunder. Interengageable fixtures are arranged within internal walls such that when those first and second casings come together, a complete socket is configured. The assembled socket is provided with an LED seat on top, and first and second passages on longitudinal ends making a first and second conductive wire to be readily route into the socket, while are separated by the insulative partition. The overall configuration is quite simple and compact.

According to one aspect of the present invention, the first and second passages of the socket can be readily provided with teeth such that the insulative layer of the conductive wires can be firmly held thereof so as to provide a strain relief. As such, accidentally interruption of interconnection between the LED and the conductive wires can be properly avoided, and reliable interconnection is therefore ensured.

Various other objects, features and advantages of the invention will be made apparent from the following description taken together with the drawings.

DETAILED DESCRIPTION OF THE PREFERRED EMBODIMENT

The drawings illustrate the preferred embodiments along with its featured characteristics and other practical functions. Detailed description will be given below.

Figure 1:
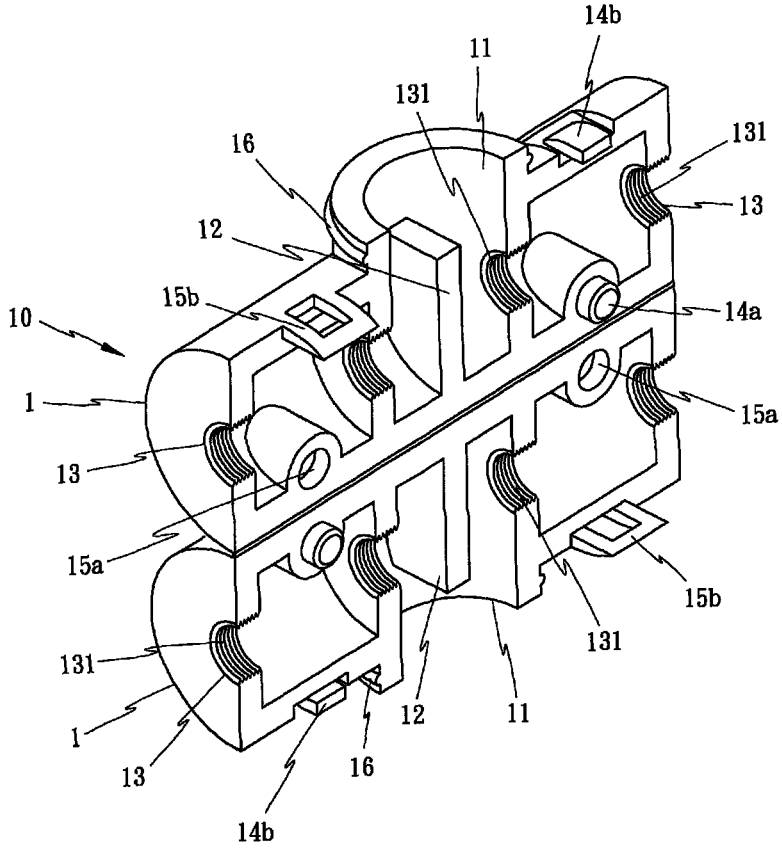
FIG. 1 is a perspective view of a socket configured by first and second casings interlinked and juxtaposed together.
Figure 2:
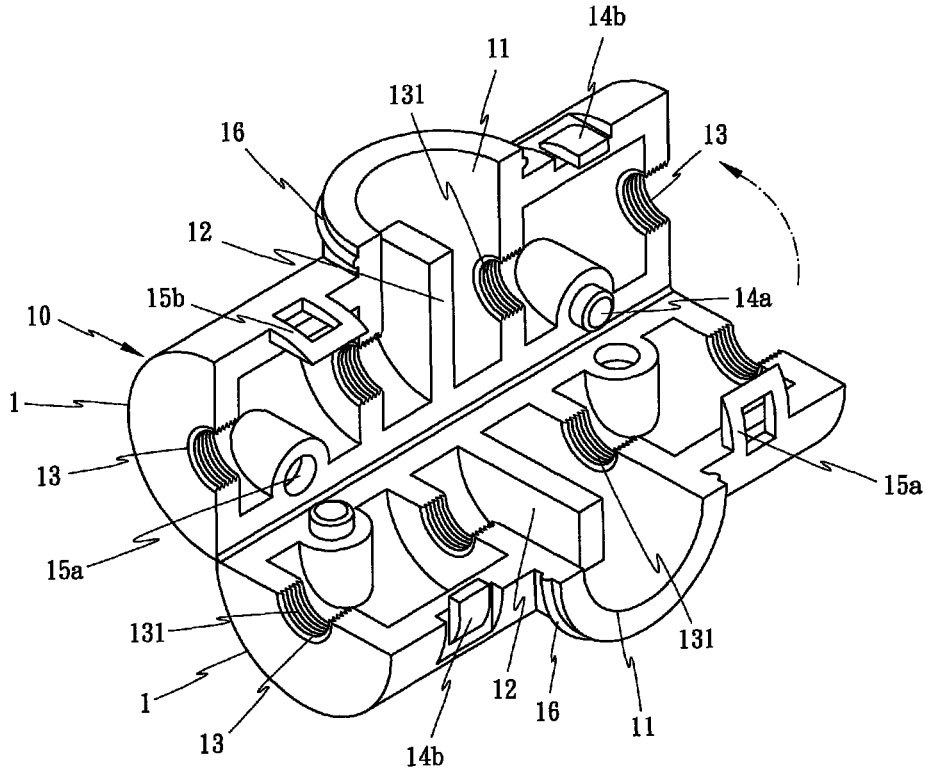
FIG. 2 is a transitional view showing the second or lower casing is rotated to engage with the first or upper casing.
Figure 3:
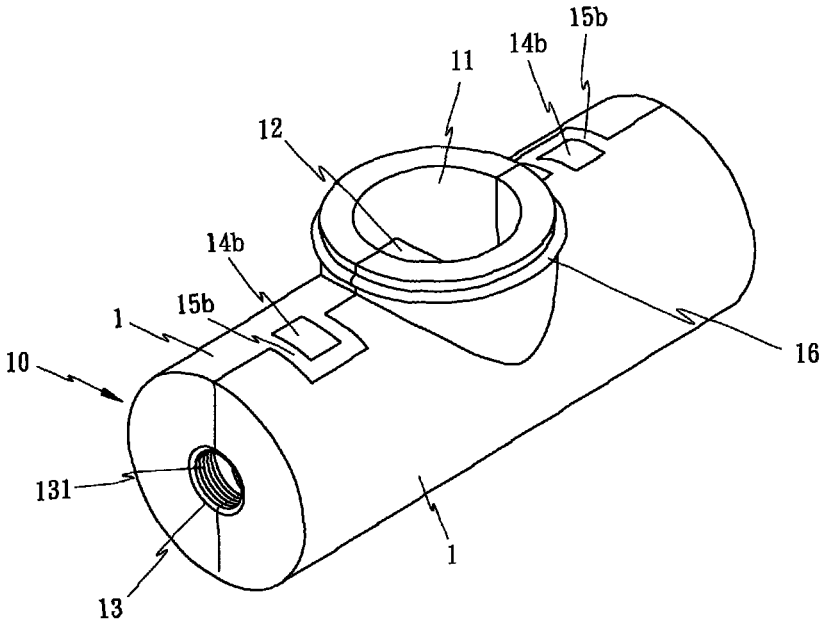
FIG. 3 is an assembled view of FIG. 2 showing a complete socket is configured.
Figure 4:
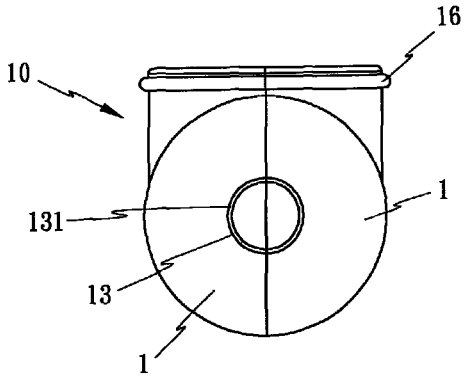
FIG. 4 is an end view of FIG. 3.
Figure 5:
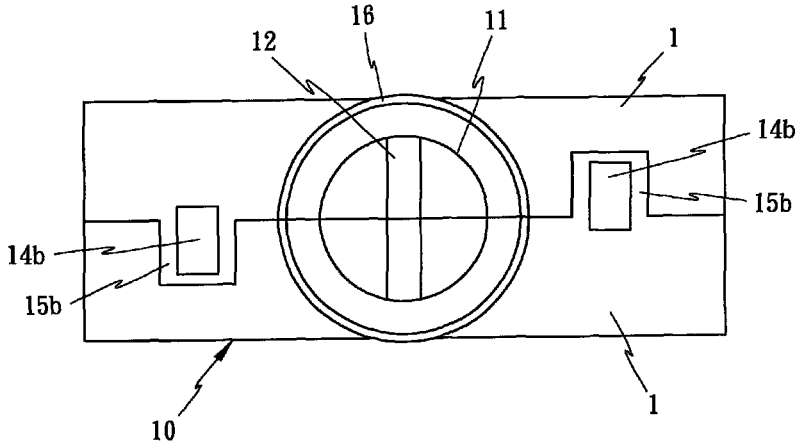
FIG. 5 is a top view of FIG. 3.
Figure 6:
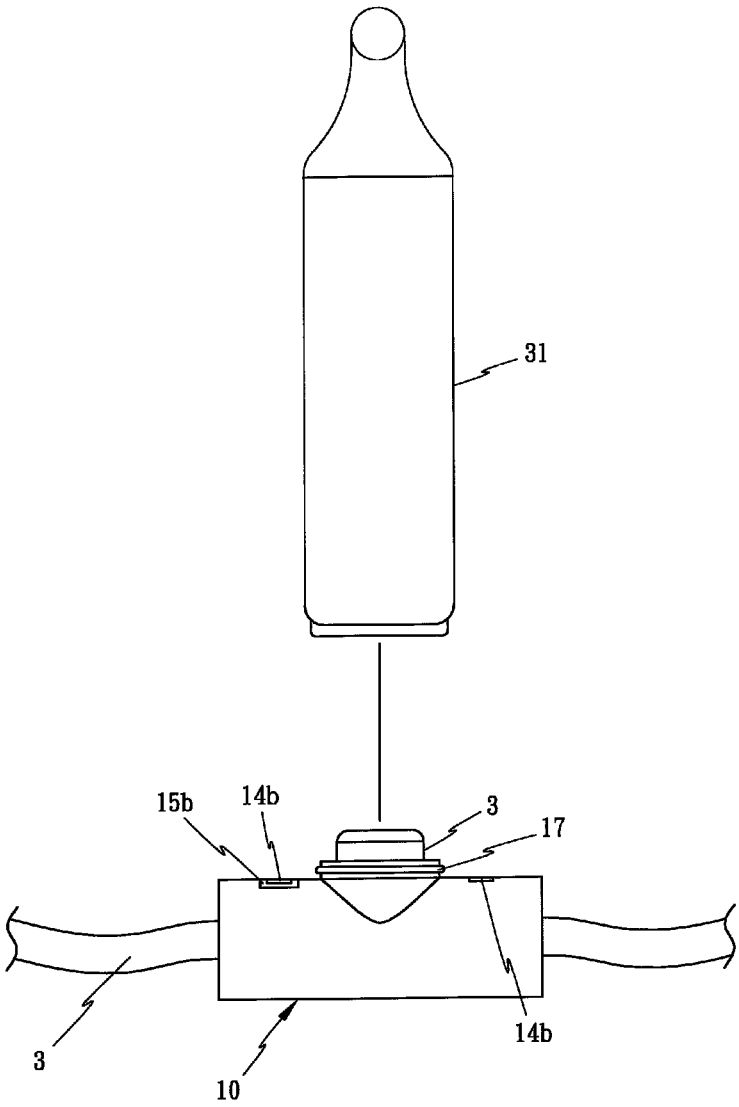
FIG. 6 is an assembled view of FIG. 1 in which an LED, light guide, and conductive wires are assembled to the socket.
Figure 7:
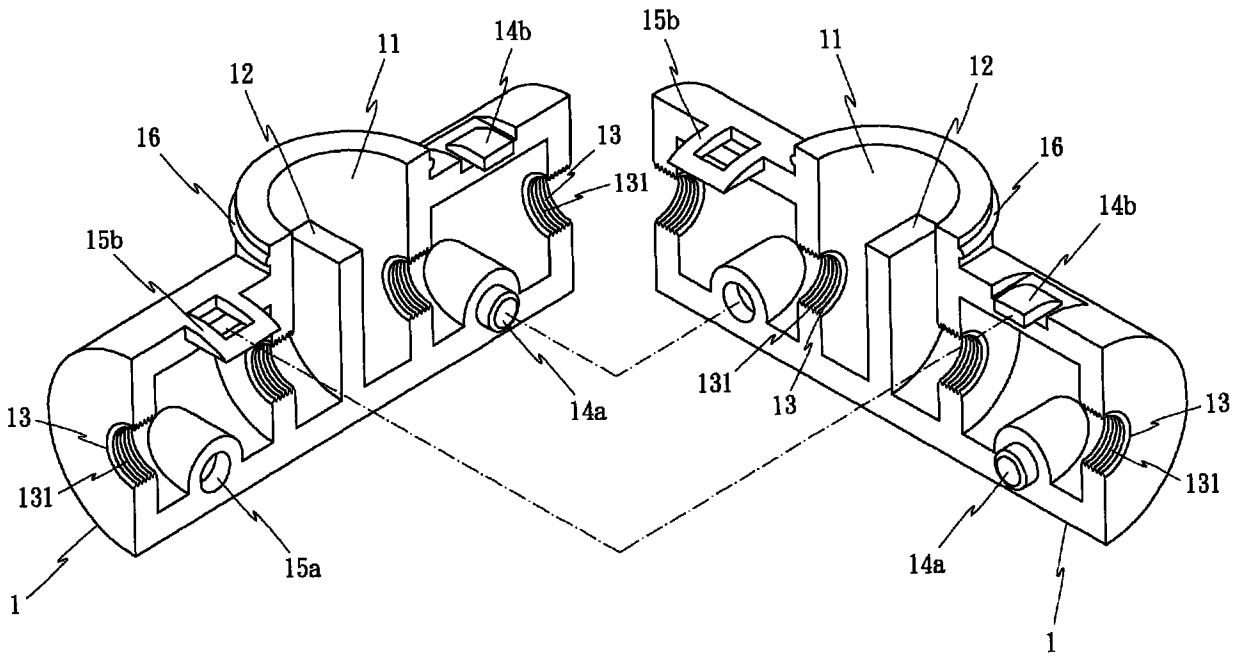
FIG. 7 is a second embodiment of the present invention in which first and second casings are separated from each other.

As shown in FIG. 1, a genuine socket configuration is provided and can be embodied as a single piece, i.e. a first and second casings 1 are interconnected which is best shown in FIG. 1, and in FIG. 7, in which the first and second casings are separated from each other as an individual part. The first and second casings are symmetrically configured. As such, there is no orientation such as top or down, or make or female. Each of the casing 1 is provided with an opening 11 with a partition 12 located thereunder, and which is integrally formed with the casing 1. Each of the first and second casing 1 is provided with a channel 13 on its side. Interlocking arrangements are provided within an inner wall and edges such that the first and second casing 1 can be readily rotated, best seen from FIG. 2. By this arrangement, the genuine socket 10 is preferably configured, best seen from FIGS. 3 to 5. Once the first and second casings 1 are assembled, an LED seat is configured by the joint of the openings 13 in which an LED 2 can be electrically seated, as shown in FIG. 6. Conductive wires 3 can be readily routed through the passage configured by the channels 13. Those two conductive wires 3 is properly isolated by the partition 12. The overall configuration of the first and second casing 1 is compact and simple, while once those first and second casings 1 are married, there are reliably secured without separation.

As shown from FIGS. 1 to 5, the first and second casings 1 are symmetrically arranged and intermateably configured. In order to provide readily interengagement, buttons 14*a* and button holes 15*a* are provided and interlocked with each other when the first and second casings 1 come together. In addition, latch 14*b* and latch holes 15*b* are also provided on the edge. By this arrangement, the socket 10 configured by the first and second casings 1 are reliably secured.

According to the present invention, an outer wall of the opening 11 is provided with a rib 16 and a complete circular rib 16 can be formed when the first and second casings 1 are jointed. A light guide 31 which can be enveloped onto the LED 3 can be readily seated and secured thereto.

For the above described socket 10 made by two symmetrically arranged first and second casings 1, since they are substantially identical, there is no distinguish for top and down, male and female. As such, this can be readily suitable for mass production with automation, fast and reliable. There is no need for manual assembling. As a result, the cost is therefore reduced and the yield is therefore increased.

According to one of the embodiment of the preferable embodiment, the first and second casings 1 each is provided with teeth 131 on the inner wall of the channels 13 such that an insulative layer or jacket (such as shown in FIG. 6) can be securely held so as to provide a strain relief to prevent external pulling force to separate an electrical joint between the LED 3 and the conductive wire 2. On other preferable embodiment, the teeth 131 can be replaced with pikes or barbs or any other arrangements such as a rough surface which can readily hold the insulative wires 2 therewith.

As shown in FIG. 7, a second embodiment of the present invention is illustrated. The difference between the first and second embodiment is that the first and second casings 1 are separated from each other instead of interlinked with interleaf illustrated in FIG. 1.

Figure 8:
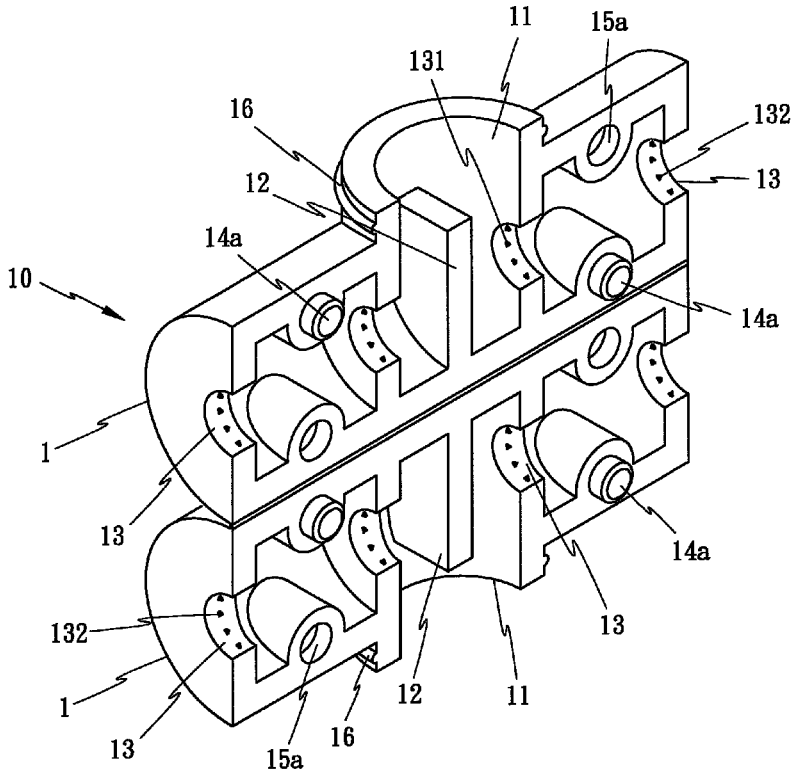
FIG. 8 is a third embodiment of the present invention in which an insulation displacement contacts (IDC) are introduced with the LED so as to make a readily interconnection between LED and conductive wires.

FIG. 8 illustrates another embodiment of the present invention, in which the teeth 131 located on the inner wall of the channel 13 is replaced with pikes 132 which can also properly get hold of the insulative layer of the conductive wires 2. On the other hand, this second embodiment is also provided with buttons 14*a* and button holes 15*a* so as to replace the latches and latch holes in the previous embodiment.

With the provision of the first and second embodiments, the first and second casings 1 can be readily embodied as interlinked, as illustrated in FIG. 1, or embodied into two separated parts, such as shown in FIG. 7. Those two different embodiments can be properly adapted into different automation for readily feeding and assembling. Either way will provide a compact and fast assembling benefiting mass productions.

While the invention has been described with reference to a preferred embodiments of a genuine socket configuration made with two symmetrically arranged casings, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

What is claimed is:

1. A socket for light string, comprising a pair of symmetrically arranged first and second casings, each of the casing featured with a side opening, and a first and second end channels, interlocking arrangements provided at internal wall thereof so as to securely interengage first and second casings to configure the socket with a LED seat formed by the openings, and passages for conductive wires configured by the first and second channels.

2. The socket as recited in claim 1, wherein a partition is formed on an inner wall of the casing and arranged under the opening.

3. The socket as recited in claim 1, wherein buttons and button holes interlocked with each other when the first and second casings come together.

4. The socket as recited in claim 1, wherein the first and second casings are provided with latch and latch holes on the edge.

5. The socket as recited in claim 1, wherein first and second casings are provided with a first and second ribs which jointly configured a donut configuration.

6. The socket as recited in claim 1, wherein an inner surface of the first and second channels is provided with circular teeth.

7. The socket as recited in claim 1, wherein an inner surface of the first and second channels is provided with pikes.

8. The socket as recited in claim 1, wherein the first and second casings are interlinked with interleaf.

9. The socket as recited in claim 1, wherein the first and second casings are separated from each other.

* * * * *